US006367162B2

(12) United States Patent
Fukumoto et al.

(10) Patent No.: US 6,367,162 B2
(45) Date of Patent: Apr. 9, 2002

(54) HAIR DRIER

(75) Inventors: Yoshiteru Fukumoto; Seisuke Takeshita, both of Tottori; Masami Fukumoto, Tottori-ken, all of (JP)

(73) Assignees: Sanyo Electronic Co., Ltd., Osaka; Tottori Sanyo Electric Co., Ltd., Tottori, both of (JP)

( * ) Notice: Subject to any disclaimer, the term of this patent is extended or adjusted under 35 U.S.C. 154(b) by 0 days.

(21) Appl. No.: 09/779,245

(22) Filed: Feb. 8, 2001

Related U.S. Application Data

(63) Continuation of application No. PCT/JP00/03084, filed on May 12, 2000.

(30) Foreign Application Priority Data

| | | |
|---|---|---|
| Jun. 8, 1999 | (JP) | 11-161167 |
| Jun. 25, 1999 | (JP) | 11-179928 |
| Dec. 24, 1999 | (JP) | 11-367540 |

(51) Int. Cl.[7] ..... A45D 20/10
(52) U.S. Cl. ..... 34/97; 392/380
(58) Field of Search ..... 34/96, 97, 98; 392/380

(56) References Cited

U.S. PATENT DOCUMENTS

| | | | | |
|---|---|---|---|---|
| 3,675,060 A | * | 7/1972 | Hills | 310/172 |
| 4,767,914 A | * | 8/1988 | Glucksman | 219/370 |
| 5,555,637 A | * | 9/1996 | Montagnino | 34/97 |
| 5,701,681 A | * | 12/1997 | Wonka et al. | 34/97 |

FOREIGN PATENT DOCUMENTS

| | | | |
|---|---|---|---|
| JP | 03906 | | 5/1989 |
| JP | 0240884 | | 10/1990 |
| JP | 04133650 | * | 5/1992 |
| JP | 04221507 | | 8/1992 |

* cited by examiner

*Primary Examiner*—Denise L. Esquivel
*Assistant Examiner*—Greg T. Warder
(74) *Attorney, Agent, or Firm*—William E. Pelton, Esq.

(57) ABSTRACT

In the present invention, winding units (19) as a stator (23) are fixedly mounted in a cylindrical housing (1). A rotor (29) is provided on vanes (26) for supplying wind. The rotor (29) is disposed to surround the stator (23), thereby forming a brushless motor (30) that provides a hair direr having low noise level and lighter construction. The rotor has a sufficiently larger dimension in a direction of flow of wind than the stator (23). The stator (23) and rotor (28) are positioned relative to each other such that the center of the stator (23) in the direction of flow of wind is at the same position as the center of the rotor (29) in the direction of flow of wind. Thus, even if the rotor (29) moves slightly in the direction of flow of wind when the rotor (29) is rotating, the torque will not change significantly.

12 Claims, 11 Drawing Sheets

HAIR DRIER

This application is a continuation of PCT International application No. PCT/JP00/03084, filed May 12, 2000, designating the United States of America, the contents of which are incorporated by reference into the present application.

TECHNICAL FIELD

The present invention relates to a hair drier and more particularly to a hair drier that incorporates a brushless motor.

TECHNICAL BACKGROUND

A hair drier primarily includes a heater bobbin on which a heater is wound, a wind tunnel having a wind guide, a commutator motor fixedly mounted to a holder disposed in the middle of the wind tunnel, and a fan fixed to a shaft of the commutator motor.

The commutator motor is an article that is assembled as a complete motor. The commutator motor is fixed on the holder mounted on the hair drier. As is disclosed, for example, in Japanese Patent Preliminary Publication (KOKAI) No. 8-343, the commutator motor extends from the holder, approaching the heater bobbin. This is because the commutator motor extends closer to an outlet than the holder due to the fact that overall length of the commutator motor is great by structural nature. This fact necessitates that the heater bobbin is shifted toward the outlet or the wind tunnel is shifted toward an inlet. As a result, the hair drier requires a larger housing.

The dc motor is connected to diodes that convert an ac voltage into a dc voltage. A commutator motor has diodes soldered to its feeding terminals. This implies that the hair drier should have a space in which the diodes are housed.

A commutator motor generates sparks because of mechanical contact of the brush with the rotor. The sparks enter television receivers and radios, creating nuisance noises in their audio outputs as well as disturbing video images.

The brush slowly wears out and the build-up of carbon particles may cause poor contact, causing decreased rotational speed or even a stoppage of the motor.

A commutator motor as a complete article is excellent in terms of assembly efficiency but a metal case that covers the motor adds a significant weight to the overall weight of a hair drier. In addition, the metal case does not provide the sufficient shielding effect against spark noise.

The recent trend is that users want to quickly dry their hair. Thus, high power heaters such as 1.2 kW and 1.3 kW are used and the fan speed is increased accordingly to provide larger volume of air.

Increasing the motor speed increases the volume of air as well as noise. This noise grates on the user's ears.

Noise generated by a hair drier is divided into two groups; noise generated by mechanical contact between the brush of the motor and electrodes and acoustic noise created when the rotating fan cuts the air. The former is an uncomfortable buzz and the brush deteriorates significantly. The latter is due to the principle that a motor drives a fan to produce wind.

Use of a brushless motor may be a solution to brush noise that grates on the user's ears.

However, the brushless motor eliminates noise due to the brush but provides less volume of air. This is because a brushless motor has a small initial torque and therefore the rotational speed is selected to be relatively low.

The present invention was made in view of the aforementioned problems.

An object of the invention is to provide a hair drier in which the motor does not generate significant noise and have a long life, and the noise from the motor does not enter televisions and radios to disturb the outputs thereof.

Another object of the invention is to provide a light weight hair drier in which parts of a motor are formed integral with parts of a drier.

Still another object of the invention is to make a compact drier having a housing with shorter overall length and yet accommodating and fixedly supporting the heater bobbin, motor, and fan therein.

A further object of the invention is to employ a brushless motor for less noise and yet for larger volume of wind.

DISCLOSURE OF THE INVENTION

In order to solve the aforementioned problems of the conventional art, a hair drier according to the present invention is characterized by:

- a longitudinally extending cylindrical housing having an inlet and an outlet so that air flows from the inlet to the outlet;
- a heater section disposed in said housing close to said outlet; and
- a wind supplying unit disposed between the heater section and the inlet;
  - wherein the wind supplying unit includes a holder in line with an axis that extends in a longitudinal direction of the housing and a base rotatably mounted on the holder, the base having a plurality of vanes that are disposed about the axis and radially extend from the axis;
  - wherein the holder has a stator with a plurality of winding units disposed around the axis, and the base has a rotor disposed around the axis such that the rotor surrounds the stator, the rotor and stator forming a brushless motor.

The holder has a plurality of wind guides that are fixed on an inner wall of the housing and radially extend, the wind guides serving to guide a flow of air generated by the plurality of vanes toward the heater section.

The base is substantially in the shape of a cylinder having an inner surface that defines an opening, the base having the rotor fixed to the inner surface and rotatably fitting over the holder.

The rotor has a dimension in a direction parallel to the axis selected to be larger than that of the stator, and the stator and rotor are positioned relative to each other such that the center of the stator in the direction parallel to the axis is at the same position as that of the rotor.

The base has a shaft and the holder has a bearing into which the shaft is inserted, the bearing is disposed closer to the outlet than the stator.

The holder has a space formed therein that accommodates a drive circuit for supplying electric power to the winding units.

The opening has an inner diameter larger than an outer diameter of the holder, so that the opening fits over the holder.

The heater section includes a heater bobbin having two insulating boards assembled together to form the shape of a cross, and a heater wire wound around the heater bobbin, wherein the heater bobbin has a diode mounted thereon for producing a d-c voltage supplied to the stator, the diode being supported across the insulating boards and being close to the holder.

A heat-shielding plate is placed between the insulating boards and the holder to isolate the diode from the holder.

The diode is a molded article having a plurality of elements therein, the article being mounted to one of the insulating boards.

BRIEF DESCRIPTION OF THE DRAWINGS

FIG. 10 is an exploded perspective view of a hair drier according to the third embodiment.

EMBODIMENT OF THE INVENTION

Embodiments of the present invention will be described in detail with reference to the drawings.

First embodiment

Figure 1:
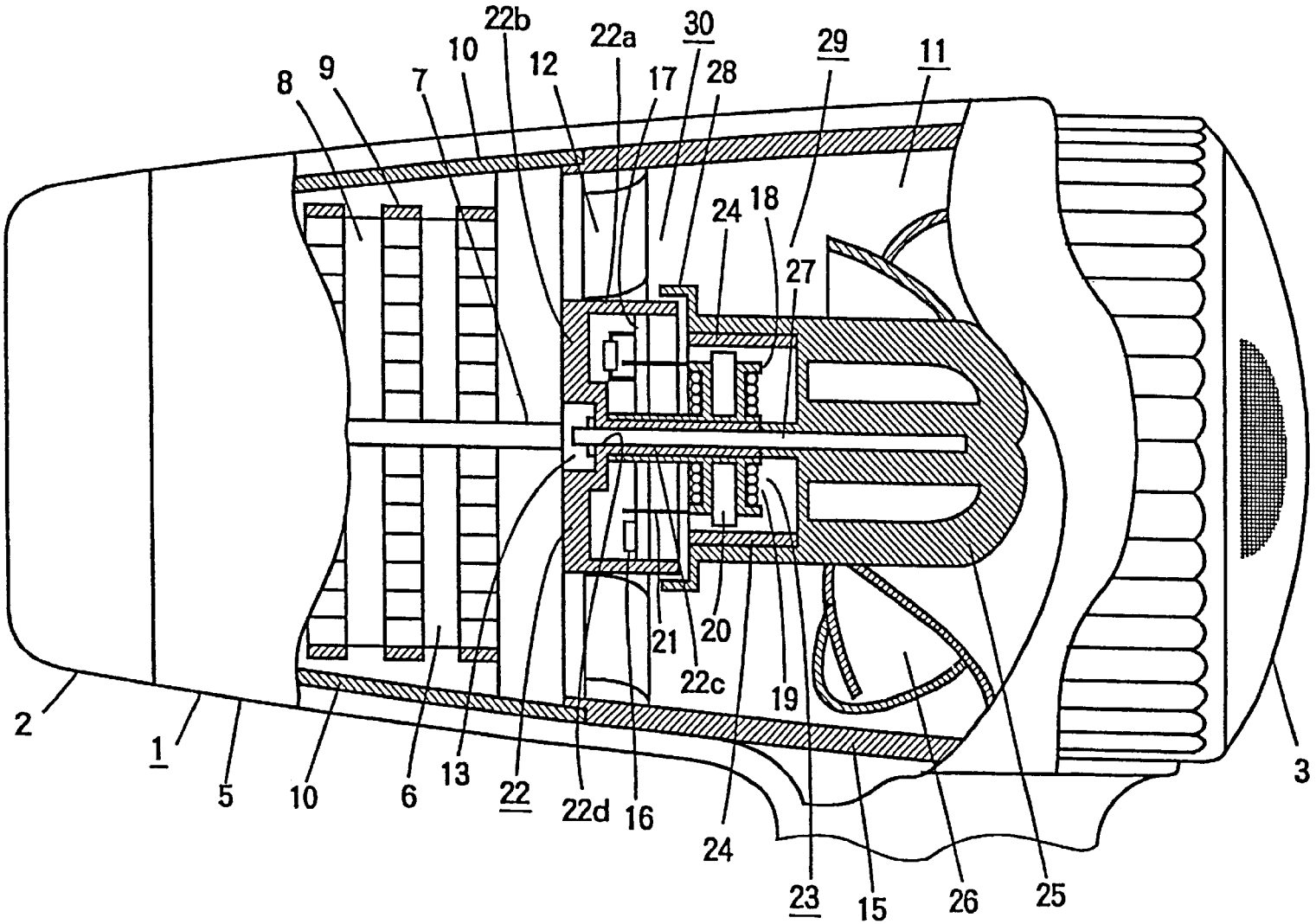
FIG. 1 is a cross-sectional view of a pertinent portion of a hair drier according to a first embodiment of the invention.

FIG. 1 is a cross-sectional view of a pertinent portion of a hair drier according to a first embodiment of the invention.

Figure 2:
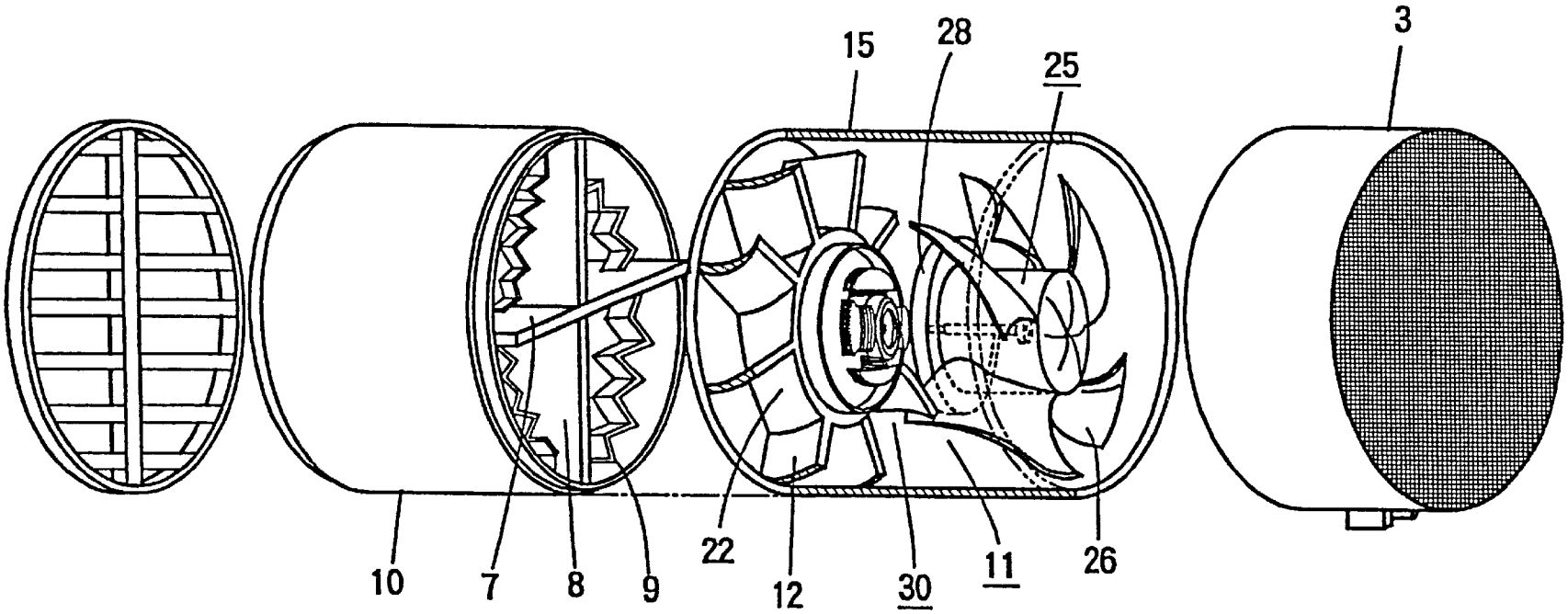
FIG. 2 is a partially exploded perspective view of the hair drier according to the first embodiment of the invention.

FIG. 2 is a partially exploded view of the hair drier according to the first embodiment.

Figure 3:
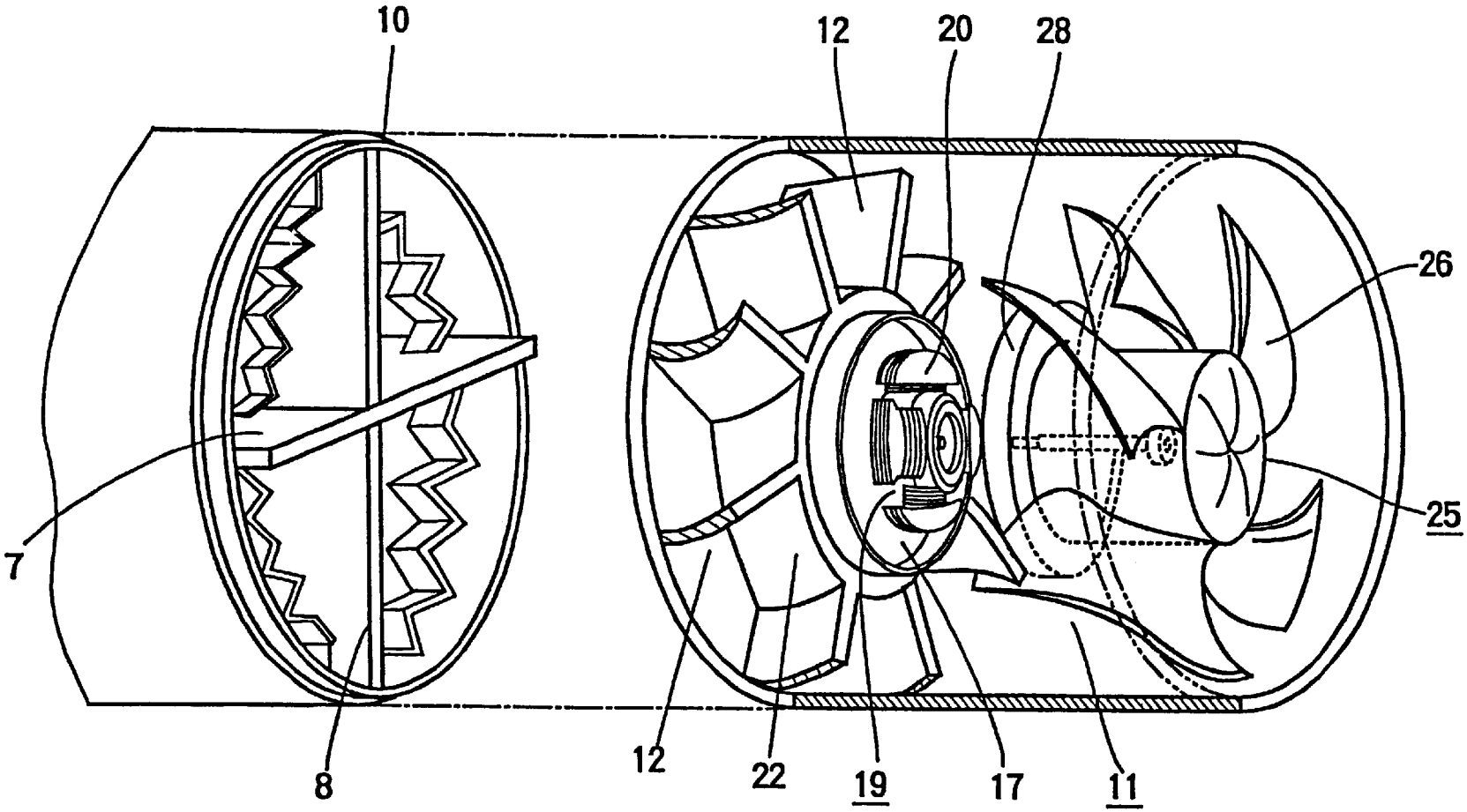
FIG. 3 is a partially exploded perspective view of the hair drier according to the first embodiment of the invention.

FIG. 3 is a partially exploded perspective view of the hair drier according to the first embodiment.

A housing 1 is substantially in the shape of a cylinder. The housing 1 has an inlet 3 at one end thereof and an outlet 2 at the other end thereof, the inlet 3 having a mesh mounted thereto. The housing 1 includes cases 5 of a split case type, not shown.

A heater assembly 6 is located in the housing 1 near the outlet 2. The heater assembly 6 includes insulating boards 7 and 8 that are assembled together to form the shape of a cross, a belt-shaped heater ribbon 9 that is wound on the insulating boards 7 and 8, and a cylindrical heat-shielding sleeve 10 that surrounds the outer periphery of the heater ribbon 9 and insulating boards 7 and 8 all around. The heat-shielding sleeve 10 is made by forming a plate-like member into the shape of a sleeve.

A fan 11 is fixedly mounted between the heater assembly 6 and the inlet 3. The fan 11 is housed in a sleeve-shaped wind tunnel 15 supported in the housing 1.

The wind tunnel 15 has an open end (FIG. 2) that faces the inlet 3 and another end to which a holder 22 and a plurality of wind guides 12 in one piece construction with the wind tunnel provided near the heater assembly 6.

The holder 22 is generally in the shape of a short hollow cylinder and has a cylindrical hub 22*a* and a bottom 22*b*. The bottom 22*b* has a recess 13 formed in the middle of the outer surface thereof. The bottom 22*b* has a through-hole that is formed in the middle of the bottom 22*b* and opens to the recess 13. The through-hole receives a later described shaft 27. The hub 22*a* has a plurality of wind guides 12 that radially extend outwardly of the hub 22*a*. The hub 22*a* has a supporting portion 22*c* that projects from the middle of the bottom 22*b* and has a through-hole 22*d* formed therein. The through-hole 22*d* serves as a bearing that bears the shaft 27. The hub 22*a* has an inner space that houses a printed circuit board 17 on which a later described drive circuit 16 is assembled. A coil form 18 made of a synthetic resin is fixedly mounted to the printed circuit board 17 by means of connecting pins 21 formed integral with the coil form 18. The coil form 18 has four winding units 19 each of which is wound around a core 20. The core 20 is in the form of a plurality of thin plates of a magnetic material stacked in a direction in which the shaft 27 extends. The core 20 is arranged such that the winding units 19 produce magnetic fluxes in directions perpendicular to the shaft 27, i.e., the magnetic fluxes are oriented toward the magnets (permanent magnets) 24. The drive circuit 16 controls the electric energy supplied through the pins 21 to the winding units 19. The drive circuit 16 can be of any well-known type and therefore the description thereof is omitted.

The winding units 19 and the core 20 form a stator 23 of a motor.

The base 25 is substantially in the shape of a hollow cylinder with one end thereof closed. The base 25 has a shaft 27 that extends from the middle of the inner bottom into the hollow cylinder. The shaft 27 extends substantially on a longitudinal axis of the wind tunnel 15. The base 25 has a plurality of vanes 26 on its outer circumferential surface, the vanes radially extending therefrom. The base 25 has magnets 24 mounted on its inner wall surface near the open end of the cylindrical base 25.

The base 25 is assembled to the holder 22 such that the shaft 27 extends through the through-hole 22*d* and the magnets 24 surround the winding units 19. The free end of the shaft 27 projects into the recess 13 and has, for example, a C-ring attached to an end portion thereof. The C-ring prevents pull out of the shaft 27 so that the base 25 is rotatable relative to the holder 22.

The magnets 24, base 25, and shaft 27 form a rotor 29 of the motor.

In other words, the rotor 29 and stator 23 form a brushless motor 30. The brushless motor 30 of the aforementioned configuration provides reduced motor noise.

The base 25 has a short hollow cylinder 28 at the open end of the base 25, the hollow cylinder 28 extending to overlap the hub 22*a* while also maintaining a gap between the hub 22*a* and the cylinder 28. The hollow cylinder 28 loosely fitting over the hub 22*a* prevents wind from entering a space defined in the hub 22*a*, thereby preventing foreign materials such as dust and debris sucked through the inlet 3 of the housing 1 from entering the space in the hub 22*a*.

When the drive circuit 16 sequentially supplies direct current to the respective winding units 19, the rotor 29 rotates due to the magnetic repulsions and attractions between the magnetic fluxes produced by the winding units 19 and the magnets 24. The wind guides 12 guide the flow of air that the rotating vanes 26 suck through the inlet 3, and increase the speed of the wind.

The first embodiment has the wind tunnel 15 that is mounted in the housing 1 and supports the motor. Instead, the wind guides 12 may be formed in one piece construction with the housing 1 on an inner surface of the housing 1, thereby eliminating the wind tunnel 15.

Second embodiment

Figure 4:
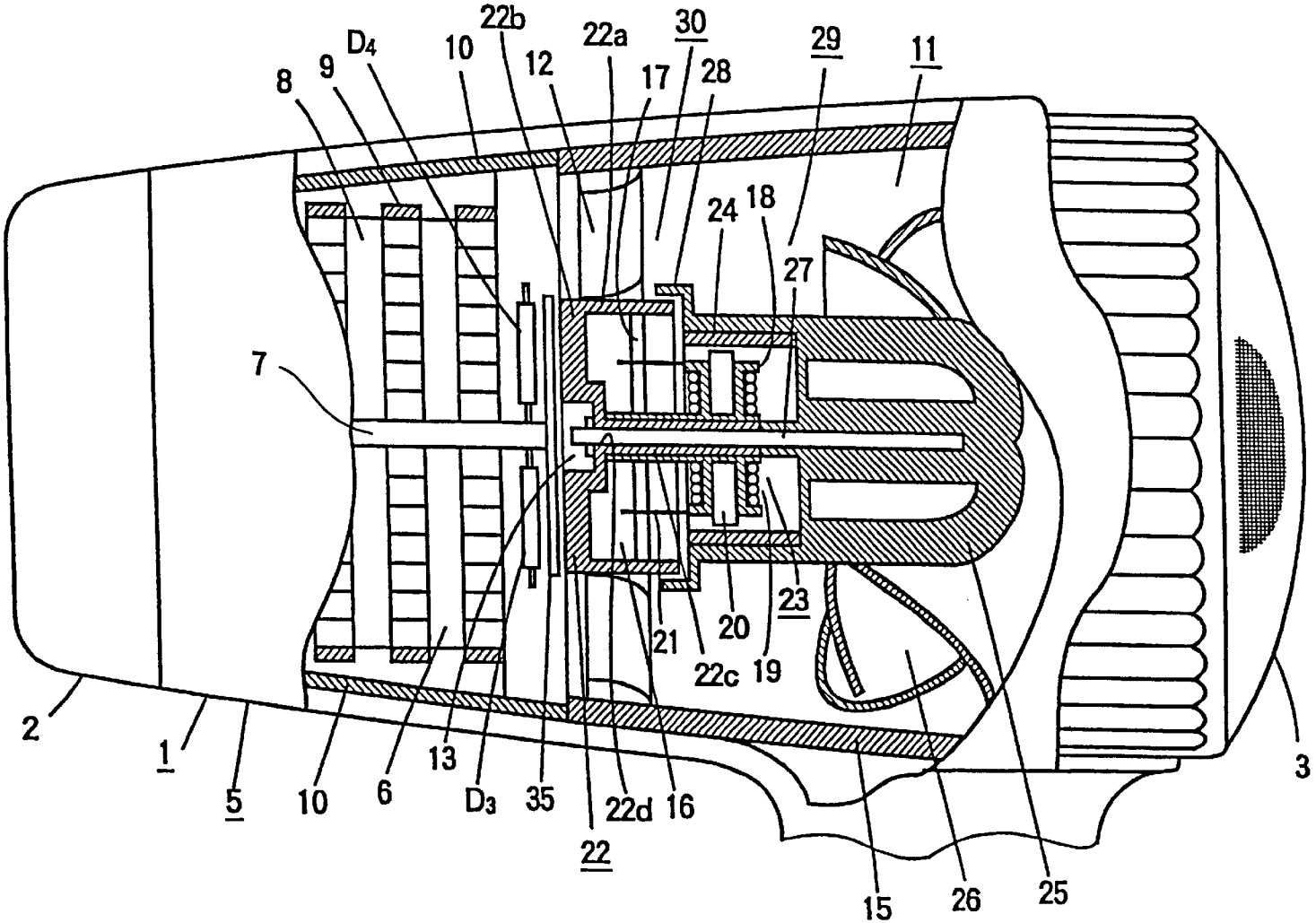
FIG. 4 is a cross-sectional view of a pertinent portion of a hair drier according to a second embodiment of the invention.

FIG. 4 is a cross-sectional view of a pertinent portion of a hair drier according to a second embodiment.

Figure 5:
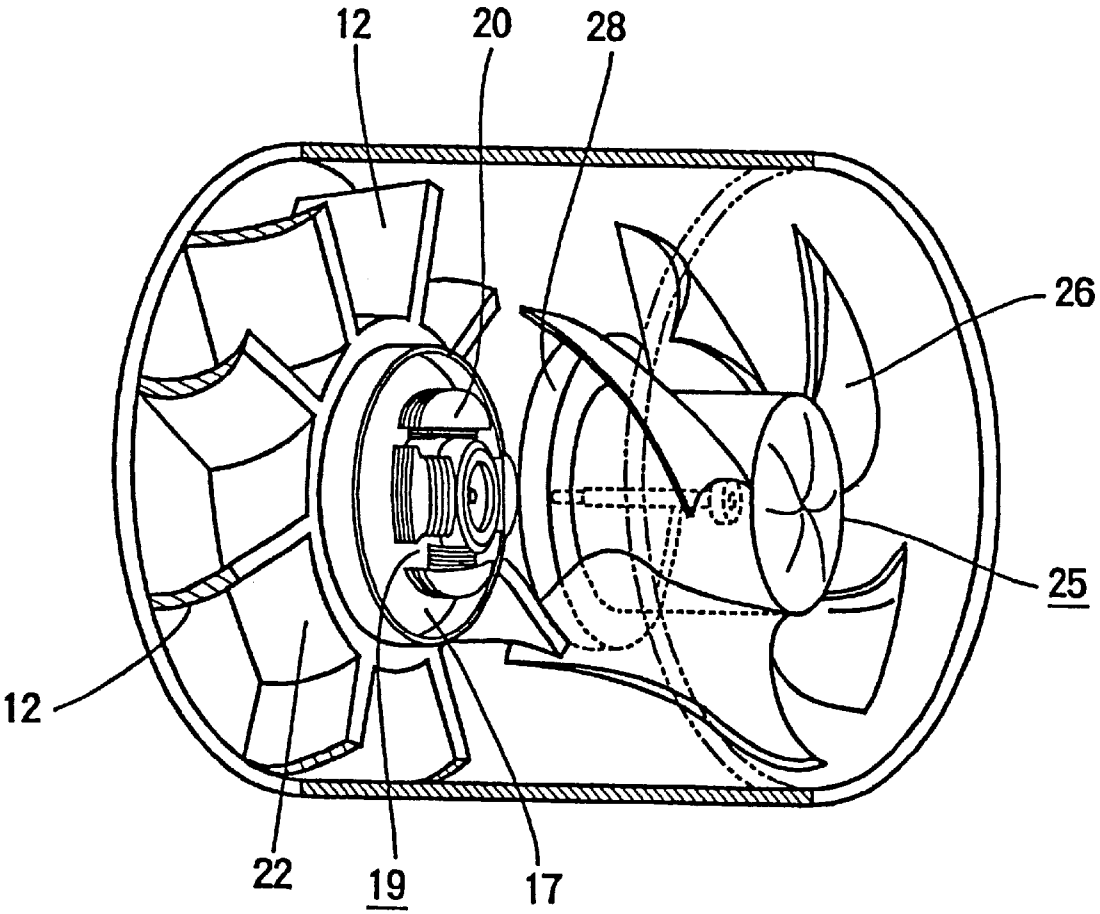
FIG. 5 is a partially exploded perspective view of the hair drier according to the second embodiment of the invention.

FIG. 5 is an exploded perspective view, partially cutaway, of the hair drier according to the second embodiment. The drier body 1 is housed in a cylindrical housing 5. The housing 5 has the inlet 3 at one end of its cylindrical body and the outlet 2 at the other end. The housing 5 has the wind tunnel 15 disposed near the inlet 3 and a heat-shielding sleeve 10 made of aluminum is disposed near the outlet 2. The heater assembly 6 includes insulating boards 7 and 8 assembled together to form the shape of a cross, the belt-shaped heater ribbon 9 that is wound on the insulating boards 7 and 8. The insulating boards 7 and 8 has substantially the same dimensions as the diameter of the wind tunnel 15, which will be described later, near the outlet 3,.

Four diodes D1–D4 are mounted to the insulating boards 7 and 8 near the wind tunnel 15. The diodes D1–D4 are mounted across the adjacent insulating boards 7 and 8, the diodes generally describing a square (FIG. 5) as a whole. Mounting the diodes D1–D4 across the insulating boards is advantageous because the diodes help the insulating boards maintain their assembled structure.

The wind tunnel 15 is a cylindrical, sleeve like member made of a synthetic resin and is fixedly mounted in the housing 5. The wind tunnel 15 has an open end that faces the inlet 3, and another end that faces the heater assembly 6, and has the plurality of stationary wind guides 12 and the holder 22 facing the heater assembly 6.

The holder 22 is generally in the shape of a short hollow cylinder and has the cylindrical hub 22*a* and the bottom 22*b*. The bottom 22*b* has the recess 13 formed in the middle of the outer surface thereof. The bottom 22*b* has the through-hole that is formed in the middle of the bottom 22*b* and opens to the recess 13. The through-hole receives the later described shaft 27. The hub 22*a* has a supporting portion 22*c* that projects from the middle of the bottom 22*b* and has a through-hole 22*d* formed therein. The through-hole 22*d* serves as a bearing that bears the shaft 27. The hub 22*a* has an inner space that houses a mounting board 17.

The coil form has four winding units 19 and has the connecting pins 21 by means of which the coil form is fixedly mounted to the mounting board 17. The winding units 19 includes the core 20 inserted and fixed therein. The winding units 19 serve as the stator 23 of the brushless motor 30. The base 25 is substantially in the shape of a hollow cylinder with one end thereof closed. The base 25 has the shaft 27 that projects from the middle of the inner bottom into the hollow cylinder and extends substantially on a longitudinal axis of the wind tunnel 15. The base 25 has a plurality of vanes 26 on its outer circumferential surface, the vanes 26 radially extending therefrom. The base 25 has magnets 24 mounted on its inner wall surface near the open end of the cylindrical base 25. The magnets 24 serve as a rotor of the brushless motor 30.

The shaft 27 extends through the mounting board 17 and has a member attached thereto that prevents pull out of the shaft 27, so that the rotor is rotatable relative to the stator.

Figure 6:
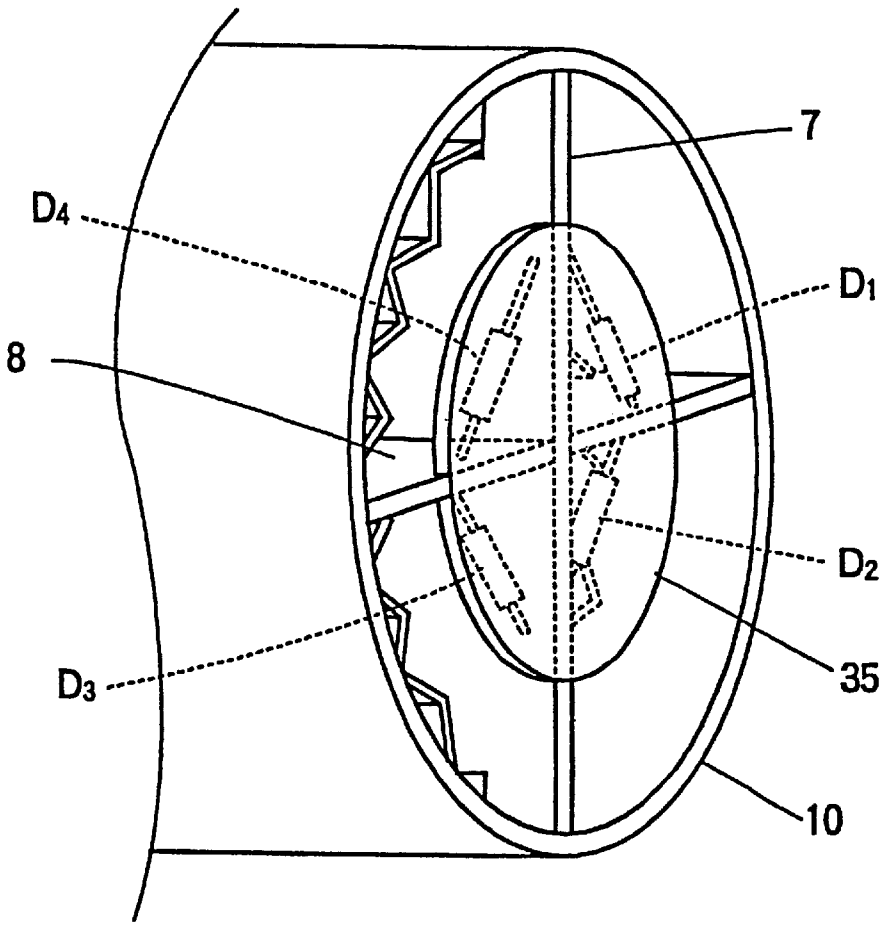
FIG. 6 illustrates a heat-shielding plate according to the second embodiment of the invention.

FIG. 6 illustrates the heat-shielding plate 35. The heat-shielding plate 35 is disposed between the holder 22 and the insulating boards 7 and 8 on which the diodes D1–D4 are mounted, to thermally isolate the holder 22 from the diodes D1–D4, thereby preventing the holder 22 from being deformed due to the heat radiated from the heater.

The heat-shielding plate 35 is substantially in the shape of a disc and is made of, for example, aluminum. The diameter of the heat-shielding plate 35 is such that a square described by the four diodes D1–D4 of FIG. 6 is inscribed in a circular contour of the heat-shielding plate 35. This arrangement is advantages because the diodes D1–D4 do not disturb the wind flowing through the wind guides 12.

Figure 7:
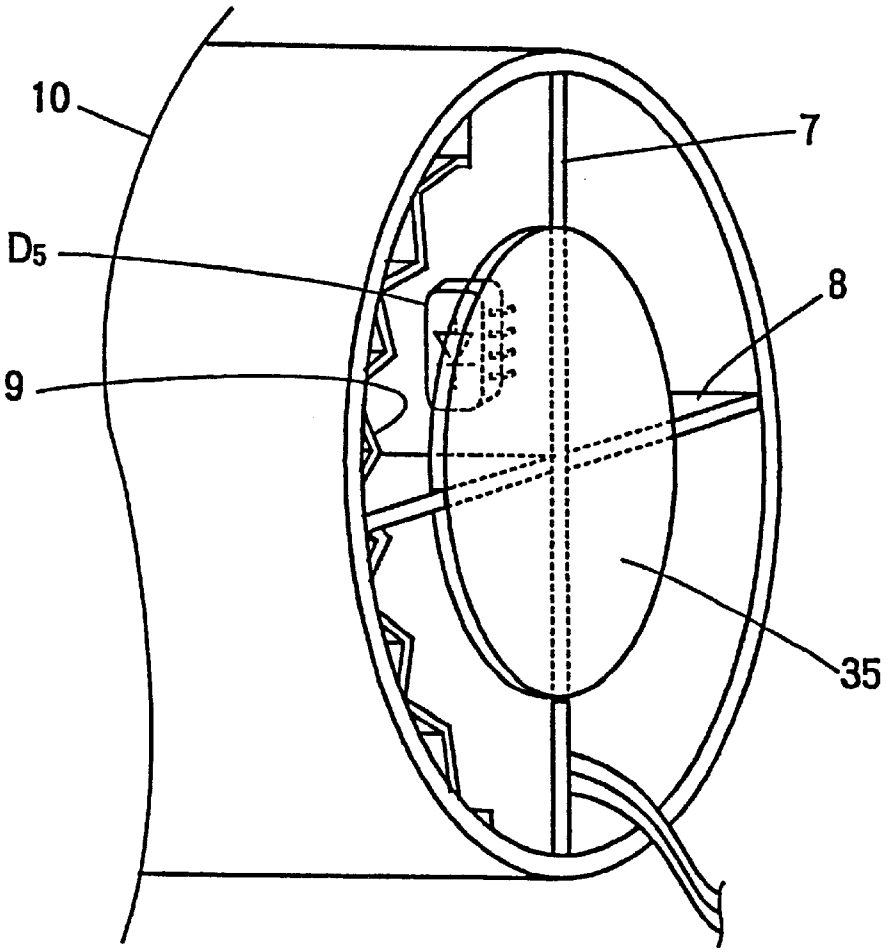
FIG. 7 illustrates a modification of a diode according to the second embodiment of the invention.

FIG. 7 illustrates a modification D5 of the diodes D1–D4. In other words, the modification D5 is a molded article that has a plurality of diodes therein. The molded article D5 is mounted to the insulating board 7. Alternatively, the molded article D5 may be mounted to the insulating board 8. Molding the diodes D1–D4 facilitates the mounting of the diodes to the insulating boards while also simplifying the wiring operation to the heater and motor.

Third embodiment

Figure 8:
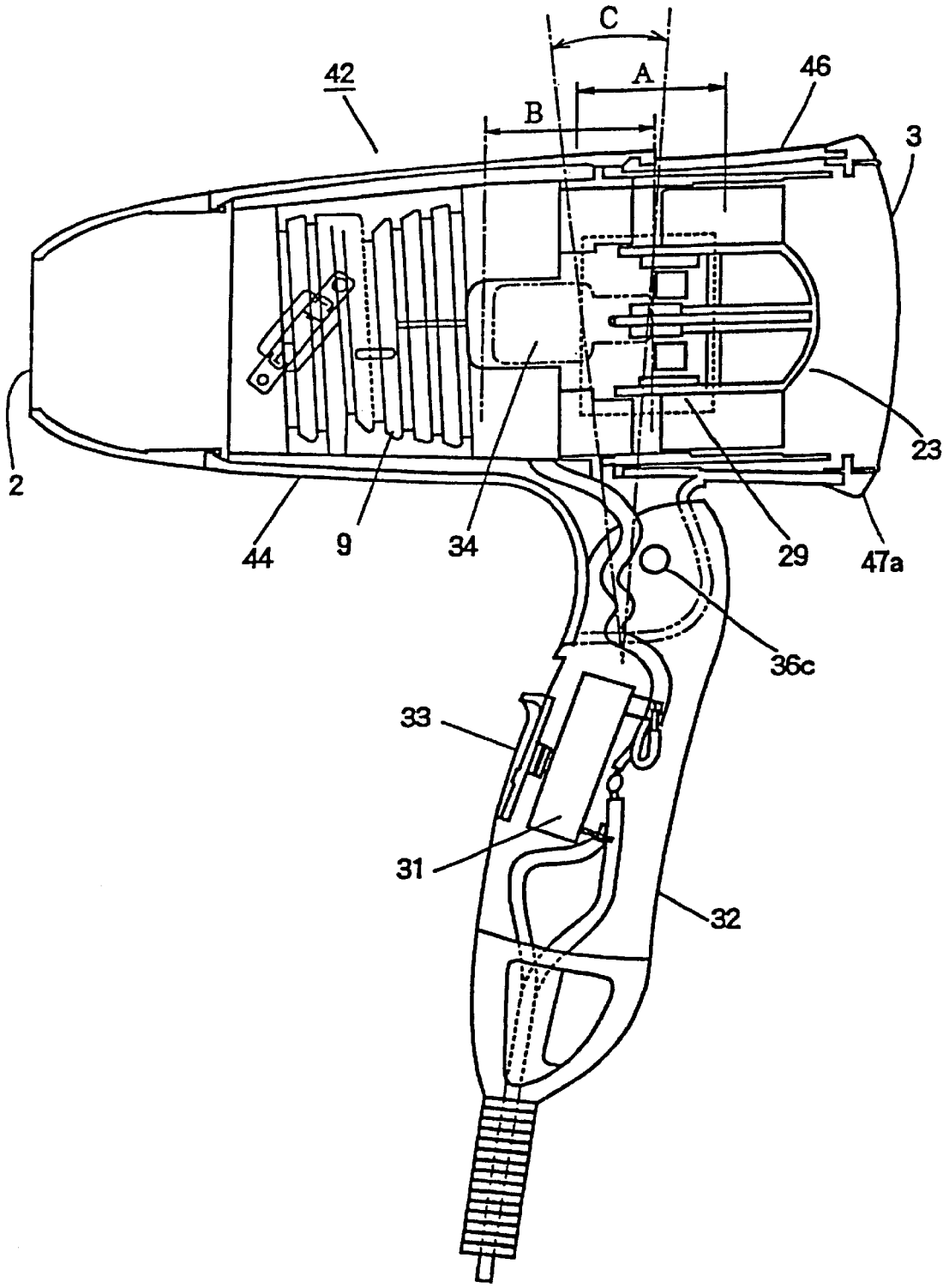
FIG. 8 is a perspective view of the inside of a hair drier according to a third embodiment of the invention.

FIG. 8 is a cross-sectional side view of a hair drier according to a third embodiment.

The hair drier 1 according to the third embodiment includes a housing 42 and a grip 32. The housing 2 is generally a cylindrical housing that includes a front housing section 44 having an outlet 5, and a rear housing section 46. The housing 42 houses a later described drier mechanism. The front housing section 44 and rear housing section 46 have a mounting 36*a* and a mounting 36*b* (FIG. 9), respectively, formed in one piece construction with the front and rear housing sections 44 and 46, respectively. The grip 32 is pivotally mounted at 36*c* to the mountings 36*a* and 36*b* so that the grip 32 is at a position shown in FIG. 8 when the hair drier is used and at a position generally parallel to the hair drier 1 when the hair drier is not used. The grip 32 incorporates power cables and a switch 31 for turning on or off the hair drier.

Figure 9:
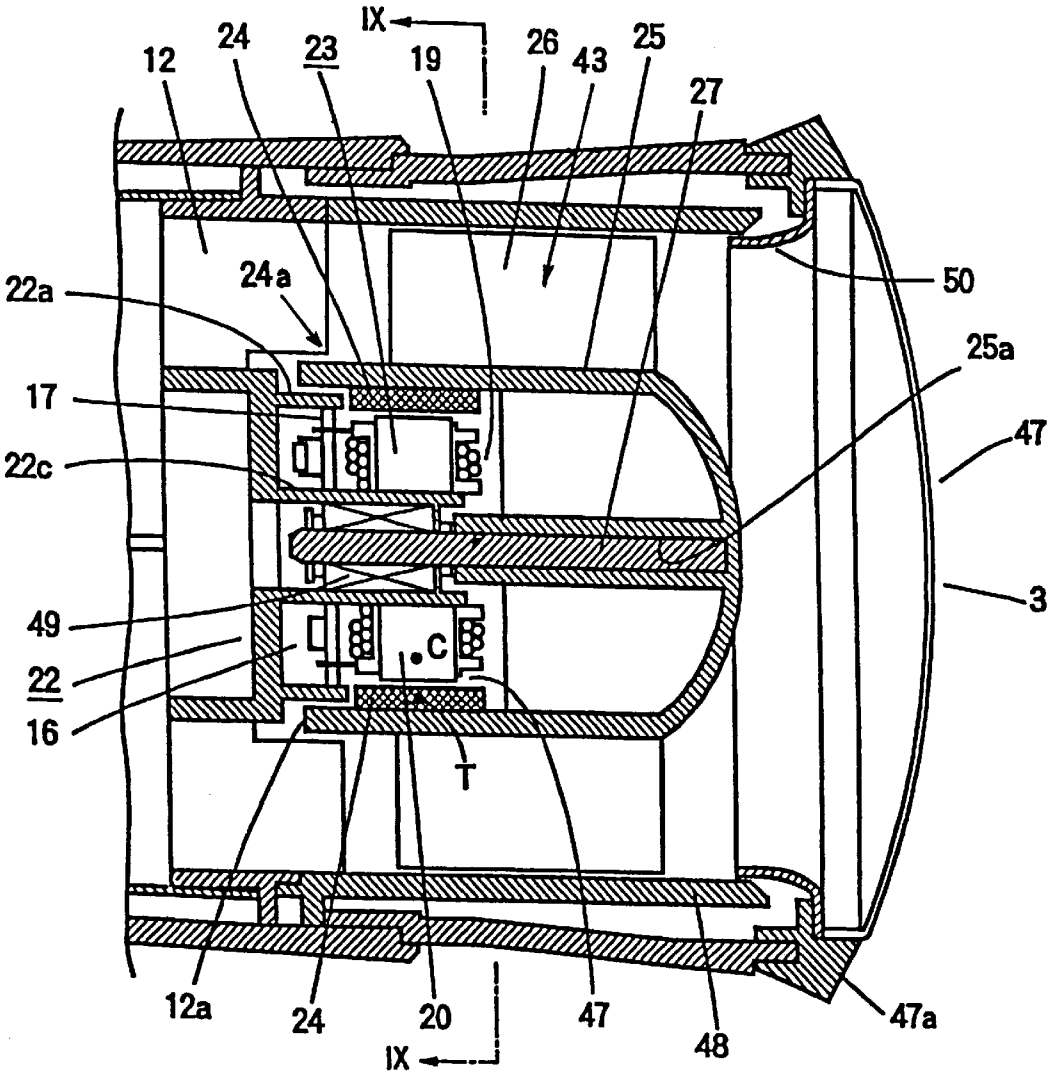
FIG. 9 illustrates a modification of the diode according to the third embodiment.
Figure 1:
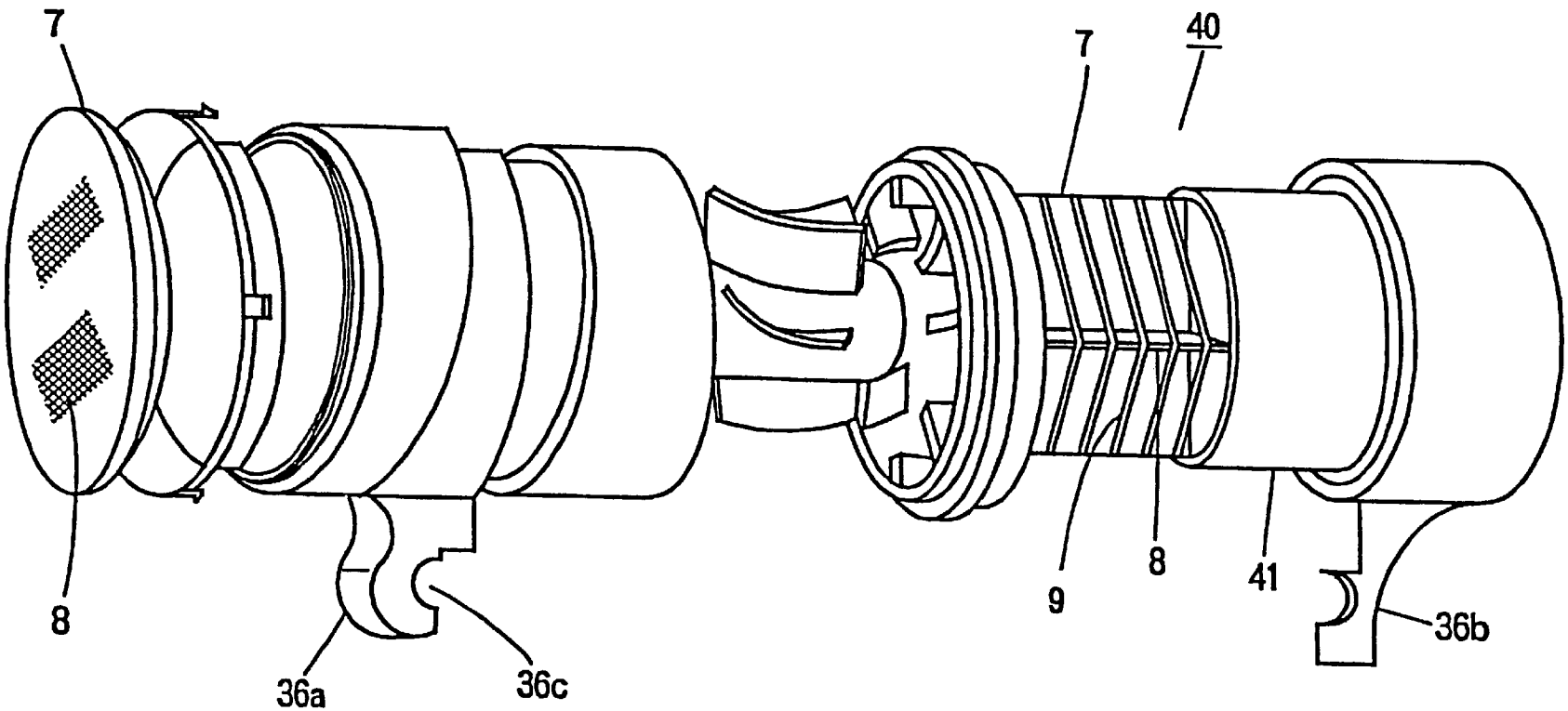
Figure 11:
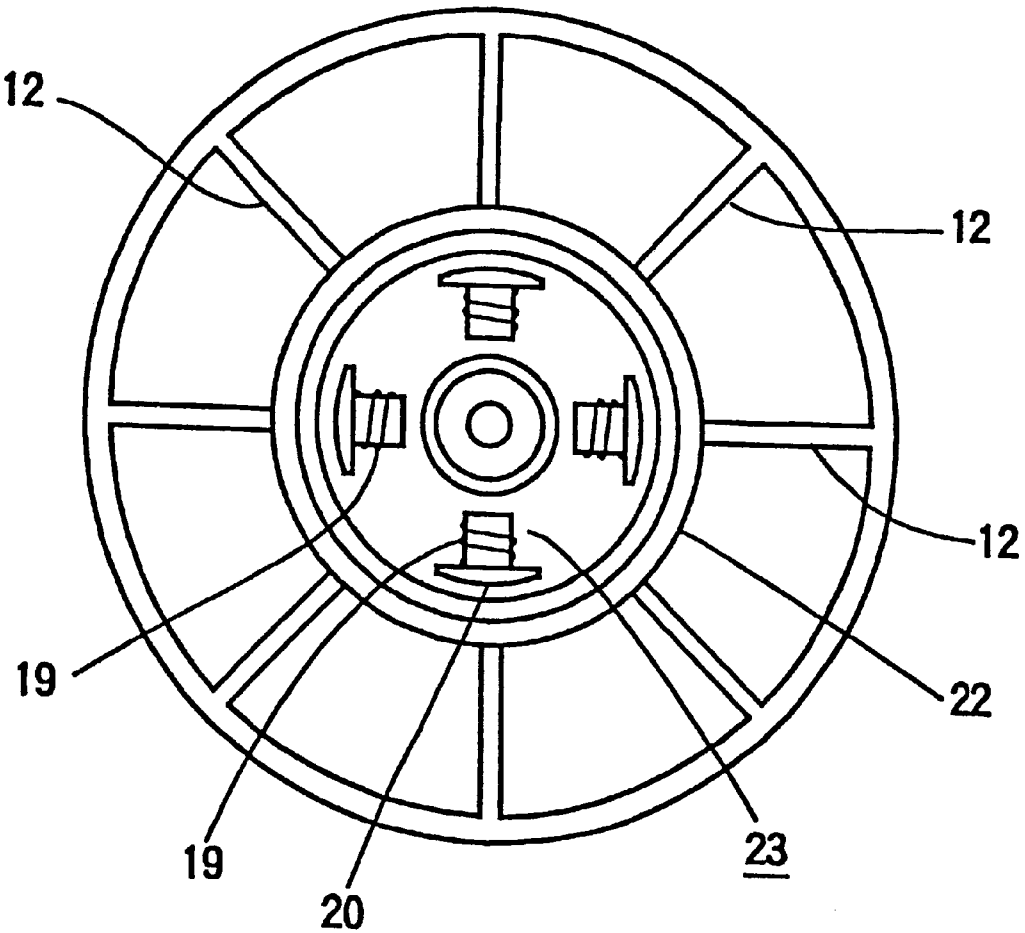
FIG. 11 is a rear cross-sectional view of the hair drier according to the third embodiment of the invention.

FIG. 9 is a rear cross-sectional view of the hair drier according to the third embodiment. FIG. 10 is an exploded perspective view of the hair drier according to the third embodiment. FIG. 11 is a perspective view taken along line XI—XI of FIG. 9. A cover ring 47*a* receives an inlet guide 50 and a cover 47 fitted to an inner surface of the cover ring 47*a*. The cover 47 has a plurality of holes formed therein, not shown, that serve as the inlet 3. The cover ring 47*a* is fitted into an end of the rear housing section 46. The front housing section 44 houses a heater assembly 40 (FIGS. 10 and 8). The heater assembly 40 includes a heat-shielding plate 41, heat-resistant boards 7 and 8, and a heater ribbon 9 that is wound on the heat-resistant boards 7 and 8.

The hub 22*a* of the holder 22 has a sleeve-like supporting portion 22*c* that extends toward the rear housing section 46. The hub 22*a* also has a plurality of wind guides 12 that radially extend in radial directions of the front housing section 44.

The supporting portion 22*c* receives a bearing 49 therein by which a later described shaft is rotatably supported. The stator 23 is disposed to surround the supporting portion 22*c*. The stator 23 includes the core 20, and the winding unit 19 wound around the core 20.

The wind guides 12 are fixedly mounted to the inner wall of the front housing section 44 so that the holder 22 is placed in position. The wind guides 12 have cutouts 12*a* formed near the hub 22*a*. The open end of the base 25 extends into the cutouts 12*a* in the direction of flow of wind. The wind guides are formed with cutouts which the open end portion of the base 25 enter to cover a portion of the cylindrical hub 22*a*, thereby preventing the wind from entering the motor. Thus, dust and foreign matters sucked into the hair drier are prevented from entering the hub 22*a*.

The cup-shaped base 25 has a narrow hollow cylinder 25*a* that extends along the center axis of the base 25. The hollow cylinder 25*a* receives a long shaft 27 inserted thereinto. The fan assembly 43 includes the cup-shaped base 25, a plurality of vanes 26 that are formed in one-piece construction with the base 25 and project radially, and rotor 24*a* including magnet rings 24 (permanent magnets) mounted to the inner wall surface of the base 25. The base 25 is assembled to the holder 22 such that the base 25 loosely fits over the stator 23 and the shaft 27 extends through the bearing 49. With the shaft 27 completely received into the bearing 49, the C-ring is attached to the end portion of the shaft 27 so as to prevent pull out of the shaft 27. Thus, the fan assembly 43 is rotatable relative to the holder 22. There is a small gap 27 between the rotor 24*a* and the core 20 so that the rotating rotor 24*a* does not collide with the core 20.

The core 20 and rotor 24*a* are positioned relative to each other such that the center C of the core 20 in a direction parallel to the shaft 27 is at the same position as the center T of the rotor 24*a* in a direction parallel to the shaft 27. The rotor 24*a* has a sufficiently longer dimension in the direction parallel to the shaft 27 than the core 20. The core 20 and the rotor 24*a* form the brushless motor 30 that drives the fan assembly 43 in rotation.

The rotor 24*a* is relatively heavy because it is formed of a permanent magnet. If a heavy part is away from the bearing 49, the gravity of the entire rotating mechanism is away from the bearing 49 so that the entire rotating mechanism tends to vibrate when the fan rotates. Therefore, the center of gravity of the rotating mechanism should be as close to the center of the bearing 49 as possible.

In the third embodiment, the bearing 49 is disposed as close to the rigid wind guides 12 as possible and the stator and rotor 24*a* are disposed as close to the bearing 49 as possible. This arrangement allows the center of gravity of the rotating parts including the rotor 24*a*, base 25, and vanes 26 to be as close to the center of the bearing 49 as possible. Because the rotor 24*a* becomes close to the wind guides 12, the open end of the base 25 that supports the rotor 24*a* can be closer to the wind guides 12. Thus, the vanes 26 that are formed on the outer periphery of the base 25 can extend closer to the wind guides 12. This shortens the dimension of the hair drier in the direction of flow of wind while maintaining the same dimension of the vanes in the direction of flow of wind. The entire base 25 approaches the wind guides 12 such that the base 25 overlaps the supporting portion 22*c* over a wider range.

The embodiment will further described with reference to FIG. 8. In the present invention, the heavy motor 30 is located within an area shown by arrow A in the body 1 of the hair drier. The area shown by arrow A is substantially directly over the grip 32.

A conventional hair drier uses a dc brush motor 34, which requires the drier to be long in the direction of the shaft of the brush motor. Thus, the fan mounted to the motor shaft is also closer to the inlet 3. As a result, the entire dimension of the hair drier is long. For this reason, the conventional motor 34 was located in an area shown by arrow B, the area being closer to the outlet 2 than the grip. Thus, when the user holds the grip during setting or drying hair, the body of the hair drier is heavier on the outlet 2 side, so that the outlet 2 tends to be oriented downward.

Women have relatively long hair, they use a hair drier for a long time accordingly. Thus, holding the hair drier tires the user's hand and the outlet 2 oriented downward prevents the warm wind from reaching a desired portion of the user's head.

The area A in which the motor 30 of the present invention occupies is substantially above the grip 32. In other words, the heaviest component of the hair drier is substantially immediately above the grip.

As a result, the center of gravity of the hair drier according to the present invention is further rearward than the center of gravity of the conventional hair drier by the area shown by arrow C of FIG. 8.

The operation of the aforementioned hair drier will be described.

When the user holds the grip 32 and pushes a trigger 33, a switch 31 is closed so that the heater ribbon 49 of the heater assembly 40 is energized to generate heat. The winding units 19 of the stator 23 are also energized to generate magnetic flux having an opposite polarity to that of the rotor 24*a*. Thus, the rotor 24*a* begins to rotate. A control circuit, not shown, controllably energizes the winding units 19 so that the winding units 19 sequentially generate magnetic fluxes having different magnetic polarities to keep the rotor 24*a* rotating. Thus, the vanes 26 rotate to create wind.

The rotating vanes 26 having a sufficient length suck air through the inlet 3 into the hair drier. The air then passes a wind tunnel 48 and is then guided by the wind guides 12. The wind that has passes through the wind guides 12 and blows against the heater ribbon 49 that heats the wind, and is then discharged through the outlet 2.

The user holds the grip 32 and moves her arms in order to orient the warm wind discharged from the outlet 2 toward a desired part of her head for setting and drying her hair. As described previously, the motor 30 is positioned substantially immediately above the mounting position of the grip 32. Thus, the center of gravity of the motor does not move greatly forward even if the hair drier is tilted so that the outlet 2 is oriented downward. The center of gravity of the motor does not move greatly rearward even if the hair drier is tilted so that the outlet 2 is oriented upward.

The sufficiently long vanes 26 are capable of sucking enough volume of air through the inlet 3.

The rotor 24*a* has a longer dimension in the direction of the shaft 27 than the core 20. Thus, even if the fan assembly 43 is somewhat shifted in the direction of the shaft 27, the rotor 24*a* still overlaps the core 20 over a sufficient distance range so that the motor provides a sufficient torque.

INDUSTRIAL APPLICABILITY

In the present invention, winding units are fixedly mounted in a cylindrical housing, thereby forming a stator of a brushless motor. A rotor is mounted to the base of wind-producing vanes. The rotor is arranged such that the rotor surrounds the stator, and rotates. This construction reduces motor noise.

The stator of the brushless motor is fixedly mounted to a wind tunnel that has wind guides therein. This construction provides light construction.

The drive circuit for driving the motor is housed in a space formed in the holder located substantially at the center of wind guides. This arrangement provides a shorter overall dimension of the motor.

The diodes for supplying electric power are mounted to the insulating boards near the holder. Thus, the heater assembly is closer to the wind tunnel on the inlet side than the conventional art hair drier.

The dimension of the rotor in the direction of flow of wind is selected to be much larger than that of the stator, and the stator and rotor are positioned relative to each other such that the center of the stator in the direction of flow of wind is at the same position as that of the rotor. Thus, even if the rotor moves slightly in the direction of flow of wind when the rotor is rotating, the torque will not change significantly.

Heavy parts of the hair drier are located closer to the outlet in the present invention than in the conventional art that incorporates a dc motor. Thus, the drier does not cause significant fatigue of the user's wrist and arm.

What is claimed is:

1. A hair drier comprising:

a longitudinally extending cylindrical hair dryer housing having an inlet and an outlet so that air flows from the inlet to the outlet;

a heater section disposed in said housing near the outlet; and a wind-supplying unit having a holder and a cup-shaped base rotatable relative to the holder;

wherein the holder has a stator with a plurality of winding units disposed on the holder, and the cup-shaped base has a rotor with a plurality of rotor elements disposed on an inner surface of the cup-shaped base and a plurality of wind-creating vanes that extend radially from an outer circumferential surface of the cup-shaped base; and wherein the cup-shaped base rotatably fits over the holder so that the plurality of winding units oppose the rotor elements to form a brushless DC motor.

2. The hair drier according to claim 1, wherein the holder has a plurality of wind guides that radially extend and are fixed on an inner wall of said housing, the wind guides serving to guide a flow of air generated by said plurality of wind-creating vanes toward the heater section.

3. The hair drier according to claim 2, wherein the base is substantially in the shape of a cylinder having an inner surface that defines an opening, the base having the rotor fixed to the inner surface and the opening receiving the holder such that the rotor is rotatable relative to the holder.

4. The hair drier according to claim 2, wherein the rotor has a dimension in a direction parallel to the axis selected to be larger than that of the stator, and the stator and rotor are positioned relative to each other such that the center of the stator in the direction parallel to the axis is at the same position as that of the rotor.

5. The hair drier according to claim 2, wherein the holder has a space formed therein that accommodates a drive circuit for supplying electric power to the winding units.

6. The hair drier according to claim 3, wherein the opening has an inner diameter larger than an outer diameter of the holder, so that the opening fits over the holder.

7. The hair drier according to claim 1, wherein the heater section includes a heater bobbin having two insulating boards assembled together to form a shape of a cross, and heater wire wound around the heater bobbin, wherein the heater bobbin has a diode mounted thereon for producing a dc voltage supplied to the stator, the diode being supported across the insulating boards and being close to the holder.

8. The hair drier according to claim 1, wherein the wind-creating vanes extend axially substantially over an entirely of the cup-shaped base.

9. The hair drier according to claim 1, wherein the cup-shaped base is disposed upstream of the holder with respect to a flow of the air.

10. A hair drier comprising:

a longitudinally extending cylindrical housing having an inlet and an outlet so that air flows from the inlet to the outlet;

a heater section disposed in said housing near the outlet; and a wind-supplying unit disposed between said heater section and the inlet;

wherein said wind-supplying unit includes a holder disposed on an axis that longitudinally extends through the housing and a base rotatably assembled to the holder, the base having a plurality of vanes that are disposed around the axis and radially extend;

wherein the holder has a stator with a plurality of winding units disposed around the axis, and the base has a rotor disposed around the axis such that the rotor and the stator form a brushless motor;

wherein the holder has a plurality of wind guides that radially extend and are fixed on an inner wall of said housing, the wind guides serving to guide a flow of air generated by said plurality of vanes toward the heater section;

wherein the rotor has a dimension in a direction parallel to the axis selected to be larger than that of the stator, and the stator and rotor are positioned relative to each other such that the center of the stator in the direction parallel to the axis is at the same position as that of the rotor; and wherein the base has a shaft and the holder has a bearing into which the shaft is inserted, the bearing is disposed closer to the outlet than the stator.

11. A hair drier comprising:

a longitudinally extending cylindrical housing having an inlet and an outlet so that air flows from the inlet to the outlet;

a heater section disposed in said housing near the outlet; and a wind supplying unit disposed between said heater section and the inlet;

wherein said wind supplying unit includes a holder disposed on an axis that longitudinally extends through the housing and a base rotatably assembled to the holder, the base having a plurality of vanes that are disposed around the axis and radially extend;

wherein the holder has a stator with a plurality of winding units disposed around the axis, and the base has a rotor disposed around the axis such that the rotor and the stator form a brushless motor;

wherein the heater section includes a heater bobbin having two insulating boards assembled together to form a shape of a cross, and heater wire wound around the heater bobbin;

wherein the heater bobbin has a diode mounted thereon for producing a dc voltage supplied to the stator, the diode being supported across the insulating boards and being close to the holder; and wherein a heat-shielding plate is placed between the insulating boards and the holder to isolate the diode from the holder.

12. The hair drier according to claim 11, wherein the diode is a molded article having a plurality of elements therein, the article being mounted to one of the insulating boards.

* * * * *